US006441839B1

(12) United States Patent
Masutani et al.

(10) Patent No.: US 6,441,839 B1
(45) Date of Patent: Aug. 27, 2002

(54) THERMAL HEAD

(75) Inventors: Hiroshi Masutani; Takayuki Yamamoto, both of Kagoshima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/698,612

(22) Filed: Oct. 27, 2000

(30) Foreign Application Priority Data

Oct. 29, 1999 (JP) ..... 11-308373
Sep. 27, 2000 (JP) ..... 2000-294950

(51) Int. Cl.[7] ..... B41J 2/335
(52) U.S. Cl. ..... 347/203
(58) Field of Search ..... 347/203, 200, 347/62, 63, 64; 430/84, 85, 57, 945, 950; 428/408, 446, 411.1, 457, 688, 689, 698, 699, 249

(56) References Cited

U.S. PATENT DOCUMENTS 4,732,834 A * 3/1988 Honda et al. ..... 430/84
6,002,418 A 12/1999 Yoneda et al. ..... 347/203
6,137,520 A * 10/2000 Kashiwaya et al. ..... 347/203

FOREIGN PATENT DOCUMENTS

| | | |
|---|---|---|
| JP | 2123764 | 5/1990 |
| JP | 6210885 | 8/1994 |
| JP | 7132628 | 5/1995 |
| JP | 11001014 | 1/1999 |

* cited by examiner

*Primary Examiner*—John Barlow
*Assistant Examiner*—K. Feggins
(74) *Attorney, Agent, or Firm*—Hogan & Hartson, LLP

(57) ABSTRACT

An object of the invention is to provide a thermal head provided with an excellent protective layer where a dielectric breakdown is hardly caused even when printing is performed on a recording medium of low moisture absorbency. In a thermal head of the invention, heating resistors are provided on an insulating substrate, and the heating resistors are coated with a protective layer containing carbon and silicon. The protective layer contains 65 to 90 atm % carbon, and carbon-to-carbon bonds of the protective layer include 95.0% or more covalent bonds related to an $sp^2$ hybrid orbital.

13 Claims, 2 Drawing Sheets

THERMAL HEAD

BACKGROUND OF THE INVENTION

1. Field of the Invention

The present invention relates to a thermal head incorporated as a printer mechanism for word processors, facsimiles or the like.

2. Description of the Related Art

A conventional thermal head incorporated as a printer mechanism for word processors or the like has a structure that a plurality of heating resistors and electrode layers are provided on an insulating substrate formed of alumina ceramics or the like with a glass-glazed layer in between, and the heating resistors are coated with a protective layer with a thickness of approximately several microns, and functions as a thermal head. A predetermined electric power is applied to the heating resistors through the electrode layers based on external image data to individually and selectively cause the heating resistors to generate Joule heat, and the generated heat is transmitted to a recording medium such as thermosensitive paper to form a predetermined print image on the recording medium.

The protective layer is provided for protecting the heating resistors and the like from abrasion due to contact of the sliding recording medium and corrosion due to contact of moisture and the like in the atmosphere. The protective layer is formed of an inorganic material having excellent abrasion resistance such as silicon nitride ($Si_3N_4$), silicon carbide (SiC) or tantalum oxide ($Ta_2O_5$).

However, in the conventional thermal head, in the case where the protective layer is formed of silicon nitride or tantalum oxide, since the specific resistances of these materials are high (e.g., silicon nitride: $1\times10^{12}\Omega\cdot$ cm; tantalum oxide: $1\times10^{14}\Omega\cdot$ cm), when printing is performed by forcing the recording medium into slidable contact with the protective layer on the heating resistors, static buildup occurs accumulated on the surface of the protective layer as the recording medium slides thereon, and when the static buildup reaches a predetermined amount, discharge occurs between the surface of the protective layer and the heating resistors, so that a dielectric breakdown of the protective layer is caused. In this case, not only the function as the protective layer is lost but also a large amount of current momentarily flows through the heating resistors with the dielectric breakdown, so that the heating resistors are burnt.

In the case where the protective layer of the thermal head is formed of a typical silicon carbide consisting of 50% carbon and 50% silicon, since the specific resistance of the silicon carbide is $8\times10^{7}\Omega\cdot$ cm which is smaller than those of silicon nitride and tantalum oxide, when static electricity is applied to the surface of the protective layer, the static charge is dissipated to some extent to decrease the occurrence of the dielectric breakdown. However, when the recording medium is formed of a material low in moisture absorbency such as plastic, an extremely large amount of static electricity is applied to the surface of the protective layer. Consequently, a dielectric breakdown is often caused like in the case of silicon nitride and tantalum oxide.

To solve the above-mentioned drawbacks, it has been proposed to cover the protective layer with a conductive layer formed of chromium (Cr) or the like so that the static charge is excellently dissipated into the entire area of the conductive layer.

However, when the protective layer of the thermal head is covered with the conductive layer, high thermal stress is applied between the protective layer and the conductive layer because the thermal expansion coefficients of the inorganic material of the protective layer and the metal such as chromium of the conductive layer are largely different. For this reason, when the recording medium slides on the surface of the conductive layer, the conductive layer easily comes off the surface of the protective layer because of the thermal stress and the slide of the recording medium, so that the charge dissipating function is lost.

SUMMARY

The invention is made in view of the above-mentioned drawbacks, and a thermal head of the invention comprises an insulating substrate, heating resistors provided on the insulating substrate, and a protective layer containing carbon and silicon, the heating resistors being coated with the protective layer, wherein the protective layer contains 65 atm % to 90 atm % carbon and carbon-to-carbon bonds of the protective layer include 95.0% or more covalent bonds related to an $sp^2$ hybrid orbital.

Moreover, in the invention it is preferable that the protective layer has a specific resistance of $2\times10^{4}\Omega\cdot$ cm to $1\times10^{7}\Omega\cdot$ cm.

Further, in the invention it is preferable that the protective layer contains 70 atm % or more carbon.

Further, in the invention it is preferable that Vickers hardness Hv of the protective layer is 1700 to 2300.

Further, in the invention it is preferable that the protective layer is formed so as to have a thickness of 1.5 $\mu$m to 4.0 $\mu$m.

Further, in the invention it is preferable that the thermal head comprises a barrier layer formed of silicon nitride, silicon oxide or SIALON (Si—Al—O—N), the barrier layer being interposed between the heating resistors and the protective layer.

Further, in the invention it is preferable that the respective heating resistors and the barrier layer contain 20 atm % to 60 atm % silicon.

A thermal head of the invetion comprises an insulating substrate; heating resistors provided on the insulating substrate; and a protective layer containing carbon and silicon, the heating resistors being coated with the protective layer, wherein the protective layer contains 65 atm % to 90 atm % carbon and carbon-to-carbon bonds of the protective layer include 95.0% or more covalent bonds related to an $sp^2$ hybrid orbital, and wherein the heating resistors are formed of an electrical resistance material selected from the group consisting of TaSiO, TaSiNO, TiSiO, TiSiCO, NbSiO and TiSiNi.

According to the thermal head of the invention, since the heating resistors are coated with the protective layer containing carbon and silicon, the carbon content of the protective layer is 65 atm % to 90 atm % and 95.0% or more of the carbon-to-carbon bonds (C—C bonds) are covalent bonds related to an $sp^2$ hybrid orbital, the protective layer is provided with moderate conductivity and a sufficient insulation property for preventing a short circuit between electrode layers, so that when printing is performed with use of a recording medium of a material low in moisture absorbency such as plastic, even if an extremely large amount of static electricity is applied to the surface of the protective layer because of the slide of the recording medium, the static charge is excellently dissipated into the entire area of the protective layer to effectively prevent a dielectric breakdown of the protective layer. Consequently, the protective layer excellently functions over a long term, so that burnout of the heating resistors due to the dielectric breakdown of the protective layer never occurs on the heating resistors.

Moreover, according to the thermal head of the invention, since the carbon content of the protective layer is 70 atm % or more, the thermochemical stability of the protective layer can be improved, so that even if the temperature of the protective layer is somewhat high, for example, when the thermal head is used, the protective layer can be effectively prevented from being partly lost because of silicon in the protective layer chemically reacting with hydroxyl radicals (OH radicals) in the recording medium. Consequently, it is possible to coat the heating resistors with the protective layer in an excellent condition over a long term.

Further, according to the thermal head of the invention, since the Vickers hardness Hv of the protective layer is in a range of 1700 to 2300, the protective layer excellently functions over a long term. Moreover, in this case, since the protective layer itself dissipates static charge, as long as the protective layer exists, the static charge due to the slide of the recording medium can be dissipated.

Further, according to the thermal head of the invention, since the barrier layer formed of silicon nitride, silicon oxide or SIALON is interposed between the heating resistors and the protective layer, the protective layer can have extremely high specific resistance, so that a problem can be effectively avoided such that when an extremely large amount of static electricity is applied to the surface of the protective layer because of the slide of the recording medium, part of the static charge flows into the heating resistors to vary the amount of the current passed through the heating resistors. In addition, corrosion due to contact of oxygen, moisture etc. in the atmosphere is more reliably prevented by excellently isolating the heating resistors from the atmosphere, so that the corrosion resistance can be further improved.

Further, according to the thermal head of the invention, since the silicon contents of the heating resistors and the barrier layer are 20 atm % to 60 atm %, the heating resistors, the barrier layer and the protective layer contain substantially the same amount of silicon, so that conformities between the heating resistors and the barrier layer and between the barrier layer and the protective layer are excellent. Consequently, the adhesions of the barrier layer and the protective layer to the substrate are improved.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Now referring to the attached drawings, a preferred embodiment of the invention will be detailed.

Figure 1:
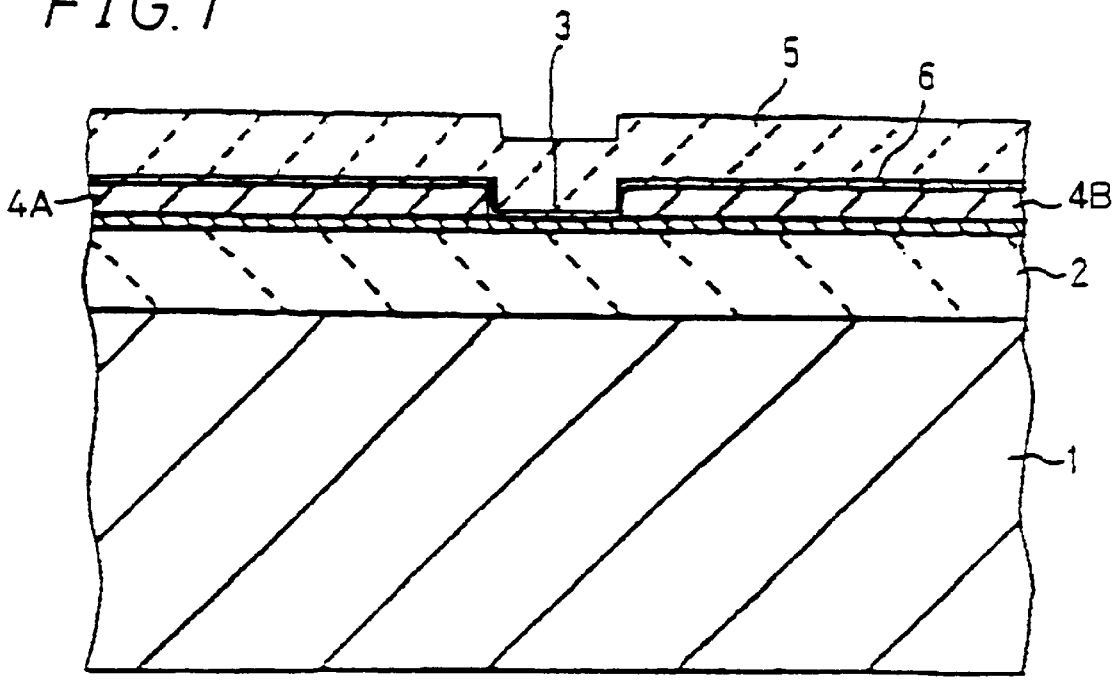
FIG. 1 is a cross-sectional view of a thermal head according to an embodiment of the invention.
Figure 2:
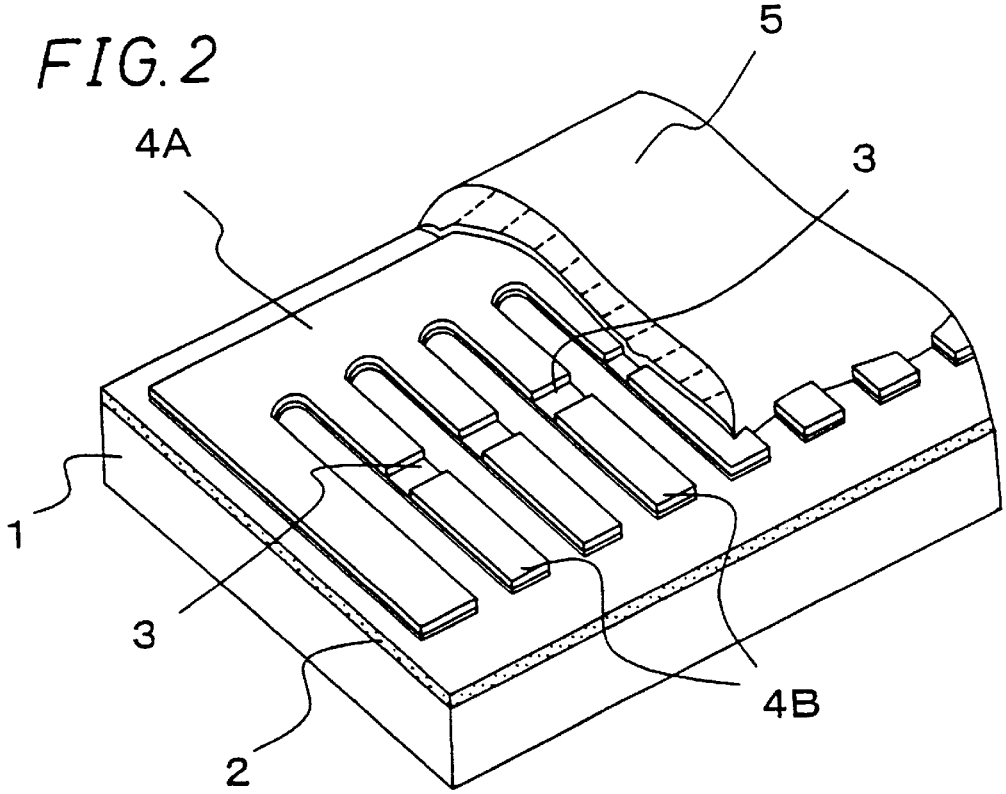
FIG. 2 is a partially cutaway view in perspective of a thermal head of the invention.

FIG. 1 is a cross-sectional view showing a thermal head of an embodiment of the invention. The thermal head comprises an insulating substrate 1, a heating resistor 3 and a protective layer 5.

The insulating substrate 1 is formed of an electrical insulating material such as alumina ceramics or glass, and the upper surface thereof functions as a supporting base material for supporting a glazed layer 2, the heating resistors 3, electrode layers 4A, 4B, the protective layer 5 and the like.

In the case where the insulating substrate 1 is formed of alumina ceramics, first, an appropriate organic solvent is added and mixed into powder of a ceramics raw material such as alumina, silica or magnesia to form slip, and the slip is formed into a ceramics green sheet by a known method such as the doctor blade method or calender rolling method. Then, the ceramics green sheet is stamped into a predetermined shape and fired at a high temperature.

On the upper surface of the insulating substrate 1, the glazed layer 2 with a thickness of 20 $\mu$m to 60 $\mu$m is formed so as to cover the upper surface.

The glazed layer 2 is formed of a low-thermal-conductivity material such as glass or polyimide resin, and accumulates heat in its inside so that the temperature of the heat generated by the heating resistors 3 is appropriate, thereby keeping excellent the thermal response of the thermal head.

In the case where the glazed layer 2 is formed of glass, a glass paste obtained by adding and mixing an appropriate organic solvent into glass powder is applied in a predetermined thickness by printing to the entire area or to a predetermined area of the upper surface of the insulating substrate by the known screen printing method. Then, the glass paste is fired at a high temperature (approximately 900° C.) to thereby form the glazed layer 2 on the upper surface of the insulating substrate 1.

On the upper surface of the glazed layer 2, a plurality of heating resistors 3 are provided so as to be aligned at a density of, for example, 300 dpi (dot per inch), and a pair of electrode layers 4A, 4B are electrically connected to both ends of each heating resistor 3.

The heating resistors 3 are formed of an electrical resistance material such as TaSiO, TaSiNO, TiSiO, TiSiCO, NbSiO or TiSiNi and have predetermined electrical resistivity per se. Therefore, when power from the power source is applied through the pair of electrode layers 4A, 4B, the heating resistors 3 generate Joule heat, so that a predetermined temperature necessary to form a print image on the recording medium, for example, 250° C. to 400° C., is reached.

The pair of electrode layers 4A, 4B connected to both ends of each heating resistor 3 are formed of a metal such as aluminum (Al) or copper (Cu), with facing each other across the heating resistor 3 and applies predetermined electric power necessary for causing the heating resistors 3 to generate Joule heat.

The heating resistors 3 and the pair of electrode layers 4A, 4B are formed by applying, for example, TaSiO and Al in a predetermined thickness in a predetermined pattern to the upper surface of the glazed layer 2 by a known thin film method, specifically, sputtering, photolithography or etching.

On the upper surfaces of the heating resistors 3 and the pair of electrode layers 4A, 4B, the protective layer 5 is formed so as to cover the upper surfaces.

The protective layer 5 is provided for protecting the heating resistors 3 and the pair of electrode layers 4A, 4B from corrosion due to contact of moisture and the like in the atmosphere and abrasion due to contact of the sliding recording medium. The protective layer 5 is formed in a thickness of, for example, 1.5 $\mu$m to 4.0 $\mu$m so as to coat the heating resistors 3 and the pair of electrode layers 4A, 4B.

The protective layer 5 is formed of an inorganic material containing carbon (C) and silicon (Si) to contain 65 atm % to 90 atm % carbon. Most of the carbon-to-carbon bonds (hereinafter, abbreviated as C—C bonds), specifically, 95.0% or more of all the C—C bonds are covalent bonds related to an $sp^2$ hybrid orbital (hereinafter, abbreviated as $sp^2$ bonds). Most of the C—C bonds are $sp^2$ bonds as mentioned above, whereby the protective layer 5 has low specific resistance within a range of $2\times10^4\Omega\cdot$ cm to $1\times10^7\Omega\cdot$ cm.

Consequently, the protective layer 5 is provided with moderate conductivity and a sufficient electrical insulation property for preventing a short circuit between the electrode layers 4A, 4B, so that when printing is performed by use of a recording medium of a material low in moisture absorbency such as plastic, even if a large amount of static electricity is applied to the surface of the protective layer 5 because of the slide of the recording medium, the static charge is excellently dissipated into the entire area of the protective layer 5, whereby the dielectric breakdown of the protective layer 5 can be effectively prevented. Consequently, the protective layer 5 excellently functions over a long term, so that the heating resistors 3 are never burnt out because of the dielectric breakdown of the protective layer 5.

In this case, since the hardness of the protective layer 5 is as high as 1700 to 2300 in Vickers hardness Hv and the abrasion resistance thereof is also excellent, the protective layer 5 excellently functions as the protective layer of a thermal head over a long term, and since the protective layer 5 itself dissipates the static charge, the static charge due to the slide of the recording medium can be dissipated as long as the protective layer 5 exits.

Further, by making the protective layer 5 so as to contain 70 atm % or more carbon, the thermochemical stability of the protective layer 5 can be dramatically improved. That is, even if the temperature of the protective layer 5 becomes, for example, as high as 300° C. or higher, when the thermal head is used, the heating resistors 3 and other part can be coated with the protective layer 5 in an excellent condition over a long term without a problem such that the thickness of the protective layer 5 decreases in a comparatively short time because of loss of much of the silicon in the protective layer 5 by silicon in the protective layer 5 chemically reacting with hydroxyl radicals (OH radicals) contained in the recording medium. Therefore, it is preferable that the protective layer 5 contains 70 atm % or more carbon.

Further, in the thermal head of this embodiment, a barrier layer 6 having a thickness of approximately 3.0 $\mu$m to 8.0 $\mu$m and formed of silicon nitride ($Si_3N_4$), silicon oxide (SiO2), SIALON (Si—Al—O—N) or the like is interposed between the protective layer 5 and the heating resistors 3.

Since the barrier layer 6 extends to the outside of the area covered with the protective layer 5 and has an extremely high specific resistance ($1\times10^9\Omega\cdot$ cm to $1\times10^{14}\Omega\cdot$ cm) compared to the protective layer 5, a problem can be reliably prevented such that when an extremely large amount of static electricity is applied to the surface of the protective layer 5 because of the slide of the recording medium, part of the static charge flows into the heating resistors 3 and the electrode layers 4A, 4B to vary the amount of the current passed through the heating resistors 3, and in addition, the heating resistors 3 and the electrode layers 4A, 4B can be excellently isolated from the atmosphere to thereby reliably protect the heating resistors 3 and the electrode layers 4A, 4B from corrosion due to contact of oxygen, moisture and the like in the atmosphere, so that the corrosion resistance of the thermal head can be further improved.

In particular, by forming the heating resistors 3 and the barrier layer 6 of compounds containing 20 atm % to 60 atm % silicon, for example, forming the heating resistors 3 of TaSiO, TaSiNO, TiSiO, TiSiCO, NbSiO or TiSiNi and forming the barrier layer 6 of silicon nitride or SIALON, the heating resistors 3, the barrier layer 6 and the protective layer 5 contain substantially the same amount of silicon, so that conformities between the heating resistors 3 and the barrier layer 6 and between the barrier layer 6 and the protective layer 5 are excellent. Consequently, the adhesions of the barrier layer 6 and the protective layer 5 to the substrate are dramatically improved. Therefore, it is perferable to interpose the barrier layer 6 formed of silicon nitride, silicon oxide or SIALON between the protective layer 5 and the heating resistors 3, and further, it is preferable to form the heating resistors 3 and the barrier layer 6 of compounds containing 20 atm % to 60 atm % silicon.

As mentioned above, the protective layer 5 is made so as to contain 65 atm % to 90 atm % carbon. This is because when the carbon content of the protective layer 5 is lower than 65 atm %, the number of $sp^2$ C—C bonds in the protective layer 5 decreases, so that the conductivity of the protective layer 5 cannot be reduced to a sufficient level. When the carbon content of the protective layer 5 is higher than 90 atm %, the number of $sp^2$ C—C bonds in the protective layer 5 is excessive, so that the conductivity of the protective layer 5 is extremely high to cause a short circuit between adjoining electrode layers 4A, 4B at the time of printing. This causes the heating resistors 3 to generate unnecessary heat, so that some part of the print image is blacked. Therefore, it is necessary that the carbon content of the protective layer 5 is within a range of 65 to 90 atm %.

Furthermore, as mentioned above, the protective layer 5 is made so that the c—c bonds include 95.0% or more $sp^2$ bonds. This is because, when the percentage of the $sp^2$ bonds is less than 95%, the specific resistance of the protective layer 5 increases because the number of covalent bonds related to an $sp^3$ hybrid orbital (hereinafter, abbreviated as $sp^3$ bonds) which are C—C bonds other than the $sp^2$ bonds increases, so that it is impossible to provide the protective layer 5 with moderate conductivity. To provide the protective layer 5 with moderate conductivity, it is necessary that most of the C—C bonds, that is, 95.0% or more of the C—C bonds are $sp^2$ bonds. The higher the percentage of the $sp^2$ bonds is, the more excellent the protective layer 5 is. It is preferable that 99.0% or more of the C—C bonds in the protective layer 5 are $sp^2$ bonds if possible.

The protective layer 5 is formed as follows. First, a target material comprising a sintered body in which carbon (C) and silicon (S) are intermixed, for example, at a ratio of 80:20 and the insulating substrate 1 covered with the heating resistors 3 and the electrode layers 4A, 4B are placed in a chamber of a sputtering apparatus, and the composition materials of the target material are sputtered by applying predetermined electric power between the target material and the insulating substrate 1 while introducing argon gas into the chamber. At this time, the flow rate of the argon gas is 100 SCCM and the pressure in the chamber is 5 mTorr. When sputtering is performed in the above-described manner, since the sputter rate of silicon is low compared to that of carbon, the formed protective layer 5 contains approximately 30 atm % silicon. a When the protective layer 5 is formed by this method, in order that 95% or more of the C—C bonds in the protective layer 5 are $sp^2$ bonds, it is important to keep the temperature of the insulating substrate 1 always within a range of 120° C. to 200° C. in forming the protective layer 5.

Thus, in the above-described thermal head a predetermined electric power is applied between the pair of electrode layers 4A, 4B based on external image data to individually and selectively cause the heating resistors 3 to generate Joule heat, and the generated heat is transmitted to a recording medium such as thermosensitive paper to form a predetermined print image on the recording medium.

The invention is not limited to the above-described embodiment but various changes and improvements are possible within the gist of the invention.

For example, while in the above-described embodiment, to form the protective layer 5, sputtering is performed by use of a single target material where carbon (C) and silicon (Si) are intermixed, the protective layer 5 may be formed by performing dual sputtering by use of a target material made only of carbon (C) and a target material made only of silicon (Si) instead.

Figure 3:
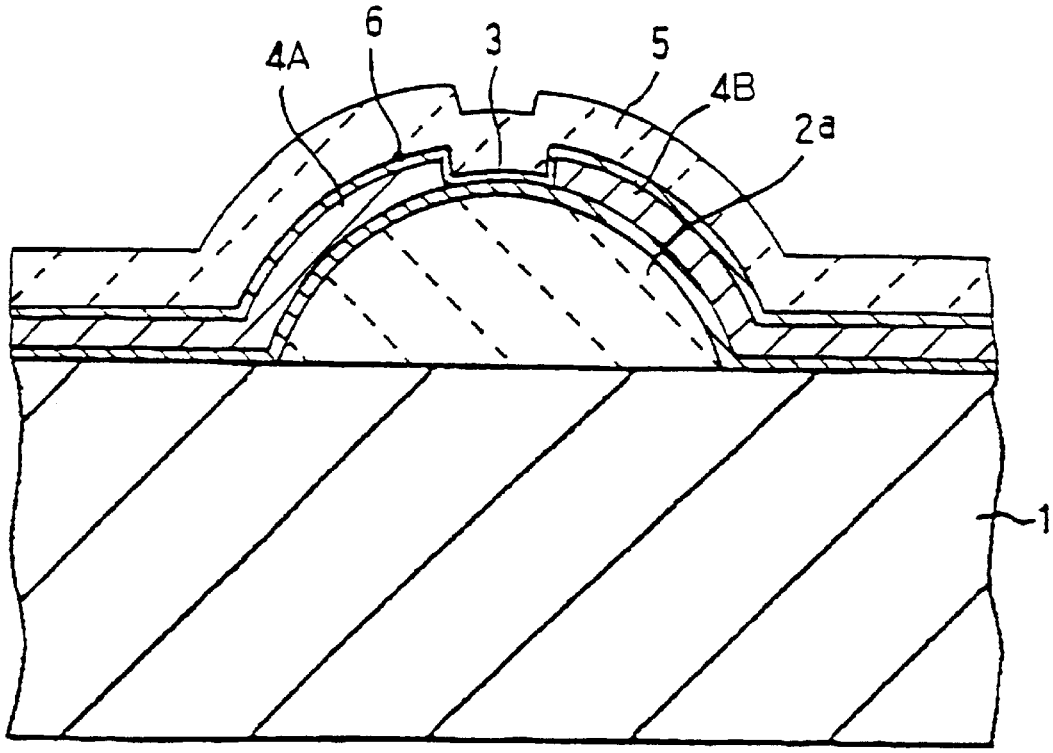
FIG. 3 is a cross-sectional view of a thermal head according to another embodiment of the invention.

While in the above-described embodiment, the glazed layer 2 is formed in a substantially uniform thickness over the entire area of the upper surface of the insulating substrate 1, instead, the glazed layer may be formed on a part of the upper surface of the insulating substrate into a shape being an arc in cross section like a glazed layer 2*a* shown in FIG. 3.

Further, in the embodiments of FIGS. 1 and 3, by removing angular parts of the surface of the protective layer 5 formed in the positions corresponding to the ends of the pair of electrodes 4A, 4B by grinding using a lapping film to which a multiplicity of diamond particles with a diameter of 0.5 $\mu$m adheres to thereby eliminate the level difference from these parts, leavings of paper caused by the slide of the recording medium can be effectively prevented from adhering to the vicinity of the perimeters of the heating resistors 3, so that the recording medium is always in close contact with the surface of the protective layer 5 on the heating resistors 3 in an excellent condition. This enables formation of sharp print images. This grinding is necessary only at least on the downstream side in the direction of conveyance of the recording medium. To more reliably obtain the above-mentioned effect, it is preferable to grind a wide area extending 100 $\mu$m to 200 $\mu$m outward from the edges of the heating resistors 3.

Test Examples

Next, the working and effect of the invention will be described with reference to test examples.

The specific resistances of the protective layers 5 of eight thermal head samples (samples Nos. 1 to 8) in which the carbon contents of the protective layers 5 are slightly different from one another, was measured, and test runs to print a test pattern (continuous printing onto one hundred thousand A4-size plastic sheets) were carried out by use of these samples. Results of the tests are shown in Table 1.

In all the thermal head samples used in these tests, the thickness of the protective layer 5 were 5.0 $\mu$m (±0.5 $\mu$m) and the protective layer 5 was formed of carbon, silicon and a certain amount of impurity (1 atm % or less), and it was verified by an X-ray photoelectron spectroscopic analysis that 99.0% or more of the C—C bonds in the protective layers 5 formed in the samples were $sp^2$ bonds.

TABLE 1

| Sample No. | Carbon content of protective layer (atm %) | Specific resistance of protective layer (Ω · cm) | Thickness reduction amount of protective layer (Å) | Presence or absence of dielectric breakdown (Absent ○) (Present x) | Presence or absence of blacked part (Absent ○) (Present x) |
|---|---|---|---|---|---|
| No. 1 | 50 | $8 \times 10^7$ | 50000 | x | ○ |
| No. 2 | 60 | $5 \times 10^7$ | 40000 | x | ○ |
| No. 3 | 65 | $1 \times 10^7$ | 30000 | ○ | ○ |
| No. 4 | 70 | $5 \times 10^6$ | 10000 | ○ | ○ |
| No. 5 | 80 | $4 \times 10^5$ | 5000 | ○ | ○ |
| No. 6 | 90 | $2 \times 10^4$ | 3000 | ○ | ○ |
| No. 7 | 95 | $8 \times 10^3$ | 1000 | ○ | x |
| No. 8 | 99 | $1 \times 10^3$ | 100 | ○ | x |

As shown in Table 1, in samples Nos. 3 to 6 the protective layers 5 contain 65 atm % to 90 atm % carbon, and have specific resistances of $2\times10^4\Omega\cdot$ cm to $1\times10^7\Omega\cdot$ cm, and as a result of the test runs using the plastic media, no dielectric breakdown of the protective layers 5 was caused and no blacked parts due to a short circuit between the electrode layers 4A, 4B were present.

On the other hand, in Samples Nos. 1 and 2 the protective layers 5 contain 50 atm % to 60 atm % carbon, and have specific resistances of $5\times10^7\Omega\cdot$ cm to $8\times10^7\Omega\cdot$ cm, which are too high. Therefore, the protective layers 5 were low in conductivity, and as a result of the test runs using the plastic media, the static charge could not be excellently dissipated and a dielectric breakdown of the protective layers 5 was caused.

In Samples Nos. 7 and 8 the protective layers 5 contain 95 atm % to 99 atm % carbon, and have specific resistances of $1\times10^3\Omega\cdot$ cm to $8\times10^3\Omega\cdot$ cm, which were too low. Therefore, the protective layers 5 were extremely high in conductivity, and in the test runs, parts blacked because of a short circuit between the electrode layers 4A, 4B were present in the print images.

With respect to the thickness changes of the protective layers 5, in Samples Nos. 4 to 8 the protective layers 5 contain 70 atm % or more carbon, and when the test runs using the plastic media were performed, the thickness reduction amounts of the protective layers 5 were 100 Å to 10000 Å which were extremely small. On the contrary, in Samples Nos. 1 to 3 the protective layers 5 contain 65 atm % or less carbon, and the thicknesses of the protective layers 5 were reduced by as much as 30000 Å to 50000 Å. Comparing these results with the results of separately performed test runs not involving printing, it was verified that such a difference was caused only in the test runs involving printing. From this, it is considered that a factor that reduced the thicknesses of the protective layers 5 of Samples Nos. 1 to 3 was that the protective layers 5 were partly lost because the temperature of the protective layers 5 was high during printing to cause silicon in the protective layers 5 to chemically react with hydroxyl radicals (OH radicals) in the recording medium.

According to the above-described test results, to obtain a protective layer 5 having a sufficient electrical insulation property and charge dissipating property for preventing a short circuit between the electrode layers 4A, 4B, it is necessary that the carbon content of the protective layer 5 is within a range of 65 atm % to 90 atm % and most of the carbon-to-carbon bonds are $sp^2$ bonds, and to obtain a protective layer 5 excellent in thermochemical stability, it is necessary that the carbon content of the protective layer 5 is 70 atm % or more.

While samples where 99.0% of the C—C bonds in the protective layers 5 were $sp^2$ bonds were used to examine the working and effect in the above-described tests, it was verified by different tests that substantially the same working and effect as those obtained in the above-described tests are obtained as long as 95.0% or more of the C—C bonds are $sp^2$ bonds.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal head comprising:

an insulating substrate;

heating resistors provided on the insulating substrate; and a protective layer containing carbon and silicon, the heating resistors being coated with the protective layer, wherein the protective layer contains 65 atm % to 90 atm % carbon and carbon-to-carbon bonds of the protective layer include 95.0% or more covalent bonds related to an $sp^2$ hybrid orbital.

2. The thermal head of claim 1, wherein the protective layer has a specific resistance of $2\times10^4\Omega\cdot$ cm to $1\times10^7\Omega\cdot$ cm.

3. The thermal head of claim 1, wherein the protective layer contains 70 atm % or more carbon.

4. The thermal head of claim 1, wherein Vickers hardness Hv of the protective layer is 1700 to 2300.

5. The thermal head of claim 1, wherein the protective layer is formed so as to have a thickness of 1.5 $\mu$m to 4.0 $\mu$m.

6. The thermal head of claim 1, comprising:

a barrier layer formed of silicon nitride, silicon oxide or SIALON (Si—Al—O—N), the barrier layer being interposed between the heating resistors and the protective layer.

7. The thermal head of claim 6, wherein the heating resistors and the barrier layer contain 20 atm % to 60 atm % silicon.

8. The thermal head according to claim 1, further comprising a barrier layer containing silicon interposed between the protective layer and the heating resistors.

9. The thermal head according to claim 8, wherein the barrier layer contains silicon in an amount from about 20 atm % to about 60 atm %.

10. The thermal head according to claim 9, wherein the heating resistors contain silicon in an amount from about 20 atm % to about 60 atm %.

11. The thermal head according to claim 9, wherein the heating resistors are formed of an electrical resistance material selected from the group consisting of TaSiO, TaSiNO, TiSiO, TiSiCO, NbSiO and TiSiNi.

12. A thermal head comprising:

an insulating substrate;

heating resistors provided on the insulating substrate; and a protective layer containing carbon and silicon, the heating resistors being coated with the protective layer, wherein the protective layer contains 65 atm % to 90 atm % carbon and carbon-to-carbon bonds of the protective layer include 95.0% or more covalent bonds related to an $sp^2$ hybrid orbital, and wherein the heating resistors are formed of an electrical resistance material selected from the group consisting of TaSiO, TaSiNO, TiSiO, TiSiCO, NbSiO and TiSiNi.

13. The thermal head according to claim 8, wherein the barrier layer contains silicon in one or more forms selected from the group consisting of silicon nitride, silicon oxide and SIALON.

* * * * *